US007011612B2

(12) United States Patent
Repking

(10) Patent No.: US 7,011,612 B2
(45) Date of Patent: Mar. 14, 2006

(54) STRETCHING DEVICE

(76) Inventor: Mary C. Repking, 2710 N. 120th Ave., Wausau, WI (US) 54401

( * ) Notice: Subject to any disclaimer, the term of this patent is extended or adjusted under 35 U.S.C. 154(b) by 208 days.

(21) Appl. No.: 10/210,916

(22) Filed: Aug. 2, 2002

(65) Prior Publication Data

US 2004/0023764 A1 Feb. 5, 2004

(51) Int. Cl.
*A63B 26/00* (2006.01)

(52) U.S. Cl. ..... 482/142; 482/79; 482/80

(58) Field of Classification Search ..... 482/146–147, 482/79–80, 34, 62
See application file for complete search history.

(56) References Cited

U.S. PATENT DOCUMENTS

| | | | | | |
|---|---|---|---|---|---|
| 145,145 | A | * | 12/1873 | Baggs | 119/69.5 |
| 1,981,379 | A | * | 11/1934 | Thomson et al. | 482/146 |
| 3,361,427 | A | | 1/1968 | Paves | 272/57 |
| 3,416,792 | A | * | 12/1968 | Morgan et al. | 482/146 |
| 3,961,787 | A | * | 6/1976 | Studebaker et al. | 272/93 |
| 3,984,100 | A | | 10/1976 | Firster | 272/96 |
| 4,107,830 | A | * | 8/1978 | Thomson | 29/110.5 |
| 4,629,181 | A | | 12/1986 | Krive | 272/97 |
| 4,826,159 | A | * | 5/1989 | Hersey | 272/146 |
| 4,951,938 | A | | 8/1990 | Smith, IV | 272/96 |
| 5,643,164 | A | | 7/1997 | Teff | 482/146 |
| 5,643,182 | A | * | 7/1997 | Engel | 601/119 |
| 5,810,703 | A | | 9/1998 | Stack | 482/146 |
| D405,135 | S | | 2/1999 | Scott | D21/688 |
| 5,897,464 | A | | 4/1999 | Mcleod | 482/79 |
| 5,897,474 | A | * | 4/1999 | Romero | 482/146 |
| 6,017,297 | A | * | 1/2000 | Collins | 482/146 |
| 6,063,010 | A | | 5/2000 | Howd et al. | 482/79 |
| 6,228,005 | B1 | | 5/2001 | Gray | 482/907 |
| 6,705,977 | B1 | * | 3/2004 | Ziak | 482/146 |

OTHER PUBLICATIONS

ProStretch/Step Stretch® , Fitness Wholesale Catalog, 1999, p. 45.

* cited by examiner

*Primary Examiner*—Gregory L. Huson
*Assistant Examiner*—L. Amerson
(74) *Attorney, Agent, or Firm*—Dicke, Billig & Czaja

(57) ABSTRACT

An apparatus is used on a surface and aids in stretching lower extremity muscles of a person in three planes of movement. The apparatus includes a plane for supporting a foot of the person. The plane has a front end, a rear end, a first edge, a second edge, a top side and a bottom side. The apparatus further includes a rear support associated with the bottom side near the rear end of the plane. The rear support extends from the first edge to the second edge. A front support is associated with the bottom side near the front end of the plane. The front support extends from the first edge to the second edge. The front support has a dimension between the surface and the plane that is greater than that of the rear support. The apparatus further includes means to rock the apparatus between the first edge and the second edge.

15 Claims, 3 Drawing Sheets

STRETCHING DEVICE

CROSS-REFERENCE TO RELATED APPLICATION(S)

None.

BACKGROUND OF THE INVENTION

The present invention relates to a stretching device. In particular, the present invention relates to a stretching device that aids in stretching the muscles of a user's lower extremities in three planes of movement.

Enhancing function during activity is a goal for athletes of all ages, active adults, individuals with disabilities, injured workers, and the elderly. The conditioning process, including flexibility training, should be directed towards improving function by application of sound biomechanics. The biomechanics of function consist of a complex combination of systems within and outside our bodies (i.e. gravity) that are linked and react with each other. An understanding of the interaction of all joints in all three planes of movement with gravity and ground reaction forces is needed to perform optimum stretching of the musculature. The three planes of movement include the frontal plane (side to side motion), the sagittal plane (frontward to backward motion) and the transverse plane (rotational motion).

In gait, running and other weight bearing activities, understanding begins with the foot. In normal gait when taking a step, the heel hits the ground and the calcaneus strikes on its lateral aspect. The calcaneus then everts (frontal plane motion) secondary to gravity and ground reaction forces. Along with the eversion, the subtalar joint abducts (transverse plane motion). Dorsiflexion then occurs by the lower leg moving across the planted foot (sagittal plane motion). These combined motions describe pronation movement in all three planes at any joint to load the muscles. Pronation is also occurring at the midtarsal joint. This is described as inversion, abduction and dorsiflexion of the forefoot in relation to the rearfoot. Pronation at the rearfoot loads or lengthens the posterior tibialis muscle and the calf muscles (including the Achilles tendon). Pronation at the forefoot lengthens the peroneus longus.

Calcaneal eversion, and the resultant pronation at the foot, causes pronation to occur along the entire lower extremity kinetic chain. Higher up the chain, the knee flexes (sagittal plane), abducts (frontal plane) and internally rotates (transverse plane). As a result, the hip follows by flexing (sagittal plane), adducting (frontal plane) and internally rotating (transverse plane). This pronation at the hip lengthens or loads the hip extensors including the hamstrings, the abductors, the iliotibial band (IT band) and the external rotators.

Stretching of the muscles is a commonly accepted practice for proper warm-up/cool-down in athletic activity. Research and clinical practice re-enforces that stretching reduces the potential for injury. All joints need to have their full range of motion in all three planes of movement to allow the body to move without deviation from the normal biomechanics and compensation by one joint because of limitations in another joint. When a joint is restricted in its motion (secondary to a shortened soft tissue), any force that drives the joint into motion it does not have will result in breakdown or acute injury at that joint or in structures somewhere above or below it within the kinetic chain. Maintaining flexibility is therefore important for the athlete as well as the person attempting to stay fit. The benefits of stretching are a) injury prevention of both acute injuries and chronic tendinitis/inflammation, b) preparing the athlete psychologically within the warm-up process, and c) allowing normal joint mechanics during activity with resultant reduction of joint immobility.

This knowledge of biomechanics demonstrates that stretching/lengthening a muscle in a single plane does not achieve full lengthening of that muscle. Additionally, most athletic activity and activities of daily living occur with one or two feet on the ground. The importance of the interaction of the joints in all three planes, the resultant lengthening of the musculature, and greater range of motion of the joints which occurs in the weight bearing position (and does not occur with the foot off the ground) enforces the need to perform stretching in both a weight bearing position and in all three planes of motion.

Past attempts at stretching devices typically offer single plane stretching in a non-weight bearing position. Devices that are weight bearing typically stretch only in the sagittal plane (front to back motion). There is a need in the art for a device that allows for biomechanically correct lengthening of the muscles of the lower extremity in all three planes in a more functional, weight bearing position. In particular the device should be able to stretch the Achilles and calf muscle group, the hamstring muscle, the IT band and the hip external rotators.

BRIEF SUMMARY OF THE INVENTION

The present invention relates to an apparatus for use on a surface and aiding in stretching lower extremity muscles of a person in three planes of movement. The apparatus includes a plane for supporting a foot of the person. The plane has a front end, a rear end, a first edge, a second edge, a top side and a bottom side. The apparatus further includes a rear support associated with the bottom side near the rear end of the plane. The rear support extends from the first edge to the second edge. A front support is associated with the bottom side near the front end of the plane. The front support extends from the first edge to the second edge. The front support has a dimension between the surface and the plane that is greater than that of the rear support. The apparatus further includes means to rock the apparatus between the first edge and the second edge.

Another preferred embodiment of the invention includes a foot plate having a top side, a bottom side, a front end, a rear end, a first edge and a second edge. A front support is associated with the bottom side near the front end of the foot plate. The front support extends from the first edge to the second edge. A rear support is associated with the bottom side near the rear end of the foot plate. The rear support extends from the first edge to the second edge. The front support and the rear support are configured to rock the apparatus between the first edge and the second edge. A middle rocker extends from the bottom side of the foot plate and is configured to allow the apparatus to rock between the front end and the rear end.

DETAILED DESCRIPTION

Figure 1:
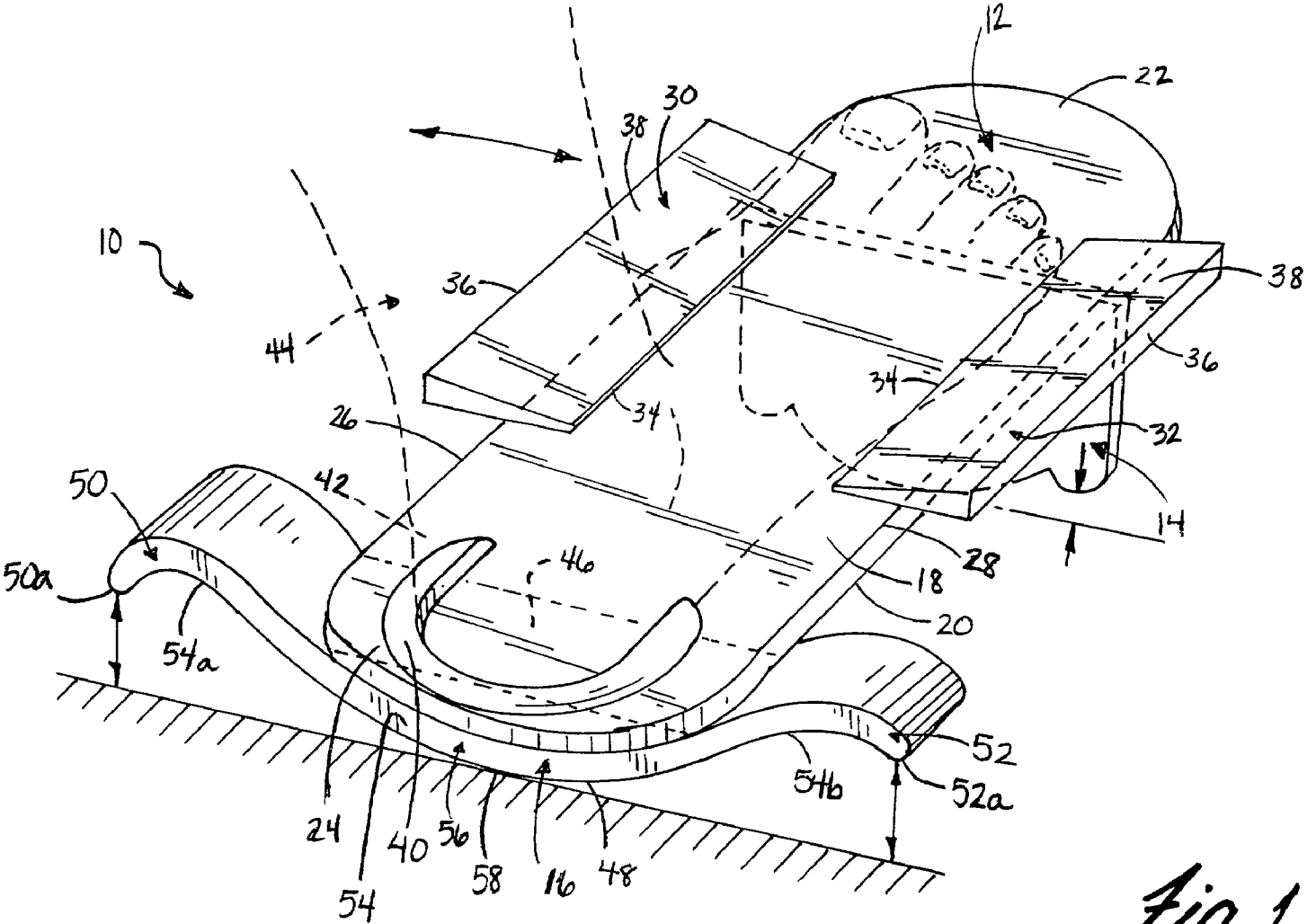
FIG. 1 is a top perspective view of a first embodiment of the stretching device.

FIG. 1 is a top perspective view of a first embodiment of a stretching device 10. The stretching device 10 has a foot plate 12, which is elevated by a front support 14 and a rear support 16. The foot plate 12 has a top surface 18 and a bottom surface 20. The foot plate 12 has a front end 22, a rear end 24, a first side edge 26 and a second side edge 28, as well as a longitudinal axis.

A first wedge 30 and a second wedge 32 are located on the top surface 18 of the foot plate 12. The first and second wedges 30 and 32 are positioned proximate the first and second side edges 26 and 28, respectively. The first wedge 30 and the second wedge 32 each have an inner side 34, an outer side 36, and a top surface 38. The outer side 36 has a height greater than the inner side 34 such that the top surface 38 lies at an angle of about 15 degrees with respect to the foot plate 12 (for each wedge). A foot support 40 is positioned adjacent the rear end 24 of the foot plate 12. Wedges 30 and 32 serve to support a respective medial or lateral portion of a user's foot at an angle relative to the foot plate 12 as will be described herein in greater detail. Those skilled in the art will recognize that other devices may be used to elevate a side of the foot above the foot plate, such as a block or any inclined surface.

In use, a heel 42 of a user's foot 44 is fixed in the foot support 40. The foot 44 is either aligned along the longitudinal axis of the foot plate 12, or the foot 44 is pivoted such that the medial or lateral extent of the foot 44 is placed on one of the wedges 30 and 32 to cant the foot 44.

The rear support 16 generally includes a top edge 46, a bottom edge 48, and first and second wing extensions 50 and 52. The top edge 46 extends from the bottom surface 20 of the foot plate 12 and the bottom edge 48 is configured to form a rear rocker 54 of the stretching device. The bottom edge 48 has an arcuate mid portion 56, which has an apex 58. The mid portion 56 is defined by an arc having ends 54*a* and 54*b*. The mid portion 56 of the rear support 16 is complimentary to the mid portion 68 of the front support. The wing extensions 50 and 52 each have an end 50*a* and 52*a*, respectively, which are aligned with ends 54*a* and 54*b* of the arcuate mid portion 56. The stretching device 10 balances on apex 58 of the mid portion 56. The mid portion 56 of the rear rocker 54 allows the stretching device 10 to rock from side to side during use. The first and second wing extensions 50 and 52 form stops that limit the range of side to side rocking to prevent the stretching device 10 from over rotating about the longitudinal axis.

Figure 2:
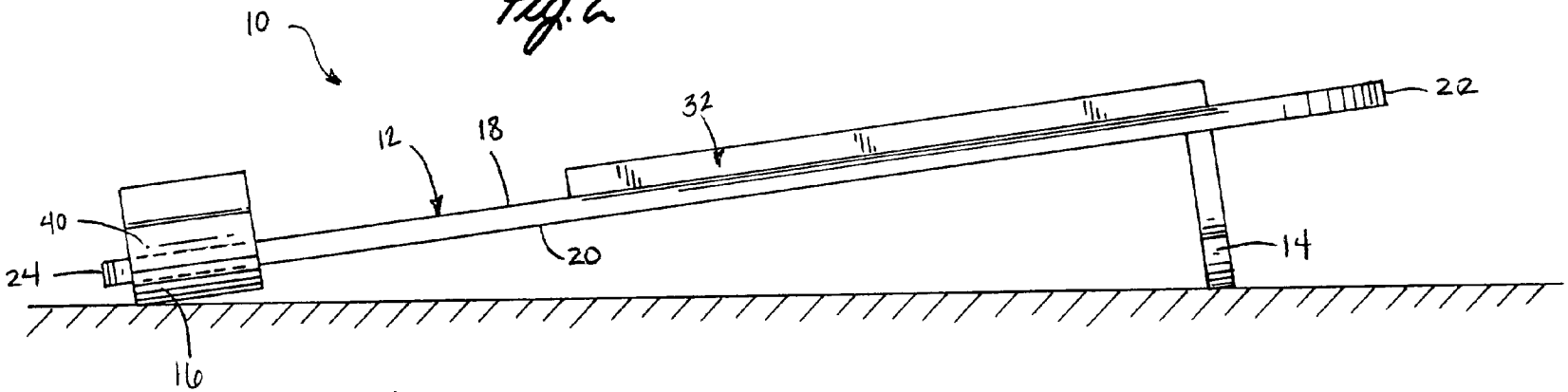
FIG. 2 is a side view of the first embodiment of the stretching device.

FIG. 2 is a side view of the first embodiment of the stretching device 10. The front support 14 extends from a bottom surface 20 of the foot plate 12 near the front end 22. The rear support 16 extends from the bottom surface 20 of the foot plate 12 near the rear end 24. The front support 14 has a vertical dimension greater than that of the rear support 16 such that the foot plate 12 forms an elevated plane of ten degrees. Thus, in the first embodiment of the stretching device 10 the front end 22 of the foot plate 12 is elevated higher than the rear end 24.

Figure 3:
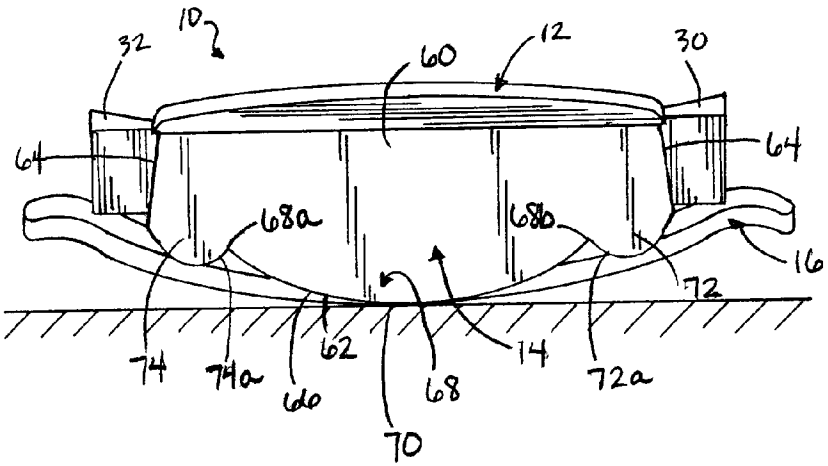
FIG. 3 is a front view of the first embodiment of the stretching device, in particular the front support.
Figure 4:
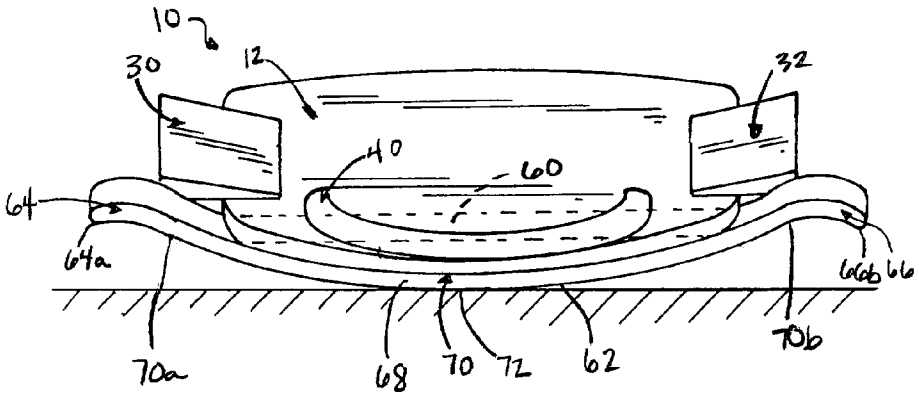
FIG. 4 is a rear perspective view of the first embodiment of the stretching device.

FIG. 3 is a front view of the first embodiment of the stretching device 10, in particular the front support 14 and FIG. 4 is a rear view of the stretching device. The front support 14 includes a top edge 60, a bottom edge 62, and side edges 64. Relative to the top edge 60, the side edges 64 diverge to the bottom edge 62, such that a width of the front support 14 is greater at the bottom edge 62 than at the top edge 60. The top edge 60 extends downward from the bottom surface 20 of the foot plate 12 and the bottom edge 62 forms a front rocker 66 of the stretching device 10.

The bottom edge 62 has an arcuate mid portion 68. The ends 68*a* and 68*b* of the arc define the mid portion 68, which has an apex 70. The mid portion 68 is flanked by a first extension 72 and a second extension 74 which extend from the ends 68*a* and 68*b* to the side edges 64. The extensions 72 and 74 each have a lower extent 72*a* and 74*a*, respectively, which relative to the ends 68*a* and 68*b* is less than the apex 70 of the mid portion 68. Before use, the stretching device 10 balances on apex 70 of the mid portion 68. The mid portion 68 of the front rocker 66 allows the stretching device 10 to rock from side to side during use. The first and second extensions 72 and 74 form stops that limit the range of side to side rocking to prevent the stretching device 10 from over rotating about the longitudinal axis. The stops formed by the first and second wing extensions 50 and 52 are coordinated with the stops formed by the extensions 72 and 74 of the front support to prevent over rotating of the stretching device 10.

The front and rear rockers configured on the bottom edges of the front and rear supports are disclosed to rock the stretching device from side-to-side. Those skilled in the art will recognize alternative structures may be utilized to facilitate side-to-side rocking, and front to rear rocking (as discussed below), of the stretching device. Examples of alternative structures include springs, an arcuate track structure or a glider-type configuration.

Preferably the stretching device 10 is comprised of plastic and is fabricated by rotational or injection molding. In addition, texturized rubber may be placed on the bottom of the front and rear supports to prevent slippage. Although the preferred stretching device is rotational or injection molded plastic, those skilled in the art will recognize other materials and manufacturing processes may be used to make the stretching device.

The stretching device of the present invention is used to stretch the lower extremity muscles of a user in three planes of motion. In particular, the muscles worked include the Achilles and calf muscle group, the hamstring muscles, the iliotibial (IT) band, and the hip external rotators. The three planes of movement include the sagittal plane (frontward and backward motion), the frontal plane (side-to-side motion) and the transverse plane (rotational motion). The present invention stretching device enhances function and flexibility for athletes, active adults, individuals with disabilities, injured workers, the elderly and many others.

To use the stretching device 10, the front and rear supports 14 and 16 of the stretching device 10 are placed on a sturdy surface, preferably the ground. A user places one foot on the top surface 18 of the foot plate 12 to stretch the muscles in the weight bearing position. The foot support 40 prevents the user's foot from sliding off the foot plate 12. The foot can either be centered along the longitudinal axis of the foot plate 12 or angled such that the forefoot rests on either the first wedge 30 or the second wedge 32. That is the foot is either rotated inward toward the center of the body or rotated outward away from the center of the body. Resting the foot on either the first or second wedge rotates the lower extremity muscles and joints (i.e. effects transverse planar motion) and causes pronation or supination at the midfoot to stretch the lower extremity muscles in the transverse plane. The elevated foot plate 12, with the front end 22 being higher than the rear end 24 elongates the lower extremity muscles to stretch them in the sagittal plane of motion. Motion in the sagittal plane is static and allows dorsiflexion. Frontal plane stretch can be either dynamic utilizing the side to side rocking motion or static by holding in the rocked position.

Although the device can be used in numerous combinations to stretch numerous muscles of the leg there are three primary stretching exercises that can be performed with the stretching device to isolate three main muscle groups: the Achilles and the calf, the hamstring, and the IT band and hip external rotators. The first stretching exercise focuses on the Achilles and calf muscle group. In this exercise the feet are in a stride stance position. The foot of one leg is placed on the surface (e.g. the floor) and the foot of the other leg is placed on the foot plate. The leg to be stretched is the back leg with its foot on the foot plate. The foot on the foot plate is centered along the longitudinal axis of the foot plate. However, the foot may also rest on the first or second wedge (placing the leg in a rotated position) to stretch the muscles in the transverse plane. Both knees should be slightly bent with the front leg knee flexion angle being greater than the back leg knee flexion angle. The user places both hands on a wall, or another substantially vertical surface, and leans into the wall to feel a gentle stretch in the leg. The user slowly rocks the stretching device side to side to shift the stretch within areas of the calf.

An additional static triplanar stretch is performed by again placing the feet in stride stance. The foot of one leg is placed on the surface (e.g. the floor) and the foot of the other leg is placed on the foot plate. The leg to be stretched is the back leg with its foot on the foot plate. The foot on the foot plate is placed with the lateral aspect of the forefoot of the leg to be stretched onto the lateral wedge (the leg is therefore externally rotated). The user places both hands on a wall, or another substantially vertical surface, slowly rocks the device to rest on the lateral edge of the outside rocker and leans into the wall to feel a gentle stretch in the leg. This stretches the calf with the relation to one another relative to the supinatory phase of gait.

A further static triplanar stretch is performed by placing the feet in stride stance. The foot of one leg is placed on the surface (e.g. the floor) and the foot of the other leg is placed on the foot plate. The leg to be stretched is the back leg with its foot on the foot plate. The foot on the foot plate is placed with the medial aspect of the forefoot onto the medial wedge (the leg is therefore internally rotated). The user places both hands on a wall, or another substantially vertical surface, slowly rocks the device to rest on the outside edge of the inner rocker and leans into the wall to feel a gently stretch in the leg. This stretches the calf with the muscles and joints of the lower extremity positioned in the relation to one another relative to the pronatory phase of gait.

The second stretching exercise elongates the hamstring muscle group. The feet are placed in stride stance position with the leg to be stretched the front leg. The foot of the stretch leg is placed on the foot plate such that the foot is rotated inward towards the center of the body and resting on the wedge. The foot of the other leg rests on the floor to the side and rear of the foot plate. The user may place a hand on a wall or other surface to aid in maintaining balance. The majority of the user's weight is on the non-stretch leg. The user bends over at the hip while keeping the knee of the stretch leg slightly flexed. The user slowly rocks the stretching device from side to side. The same stretch can be performed with foot placed on the wedge so that the leg is outwardly rotated or with foot centered along the longitudinal axis of the foot plate. Alternatively, this stretch can be performed on the stretch leg with the non-stretch leg placed on the stretching device. The foot of the non-stretch leg is rotated inward and rests on the inward wedge. The user slowly rocks the device side to side.

The third stretching exercise focuses on the IT band and the hip external rotators. The foot of the stretch leg is placed on the foot plate such that the foot is rotated inward towards the center of the body and rests on the wedge. The foot of the non-stretch leg rests on the floor to the side and forward of the foot plate. The majority of the weight bearing is on the stretch leg. The user rocks the stretching device inward and holds. Then the user gently moves the hip of the stretch leg diagonally rearward to the left and right (anterior lateral and posterior lateral vectors). Additional hamstring stretch can be done in this position by gentle knee flexion extension excursions of the stretch leg.

Prior to use, the stretching device rests in a neutral position with the apexes 70 and 58 of the supports 14 and 16 in contact with the floor and the ends 68*a*, 68*b*, 54*a* and 54*b* substantially parallel to the floor. The rockers 66 and 54 of the front and rear supports 14 and 16 permit the stretching device 10 to rotate about the longitudinal axis, or rock from side-to-side (frontal plane motion) with respect to the neutral position. Movement of the stretching device 10 in the frontal plane allows eversion/inversion stretching of the lower extremity muscles. Both the front rocker 66 and the rear rocker 54 have stops formed at their respective extensions. The stops prevent the stretching device 10 from rotating beyond a particular angle on either side with respect to the neutral position, preferably about 10 degrees for a total frontal plane of motion of about 20 degrees. Those skilled in the art will recognize that there are other means for allowing the apparatus to rock side to side, including springs located between the supports and the foot plate.

During running and other weight bearing activities, the heel hits the ground and the calcaneus strikes on its lateral aspect wherein the calcaneus then everts secondary to gravity and ground reaction forces. Calcaneal eversion, and the resultant pronation at the foot, causes pronation to occur along the entire lower extremity kinetic chain, including the knee and hip. Both the knee and the hip follow with motion in the sagittal plane (flexing), the frontal plane (abducting/adducting) and the transverse plane (internally rotating). This knowledge of biomechanics demonstrates that stretching of a muscle in a single plane does not achieve full lengthening of the muscle. The joints in the lower extremities require a full range of motion in all three planes of movement such that the body moves without deviation from normal biomechanics or compensation because of limitations in another joint. The importance of the interaction of the joints in all three planes, the resultant lengthening of the musculature, and greater range of motion of the joints in the weight bearing position illustrates the need to perform stretching in the weight bearing position and in all three planes of motion.

Figure 5:
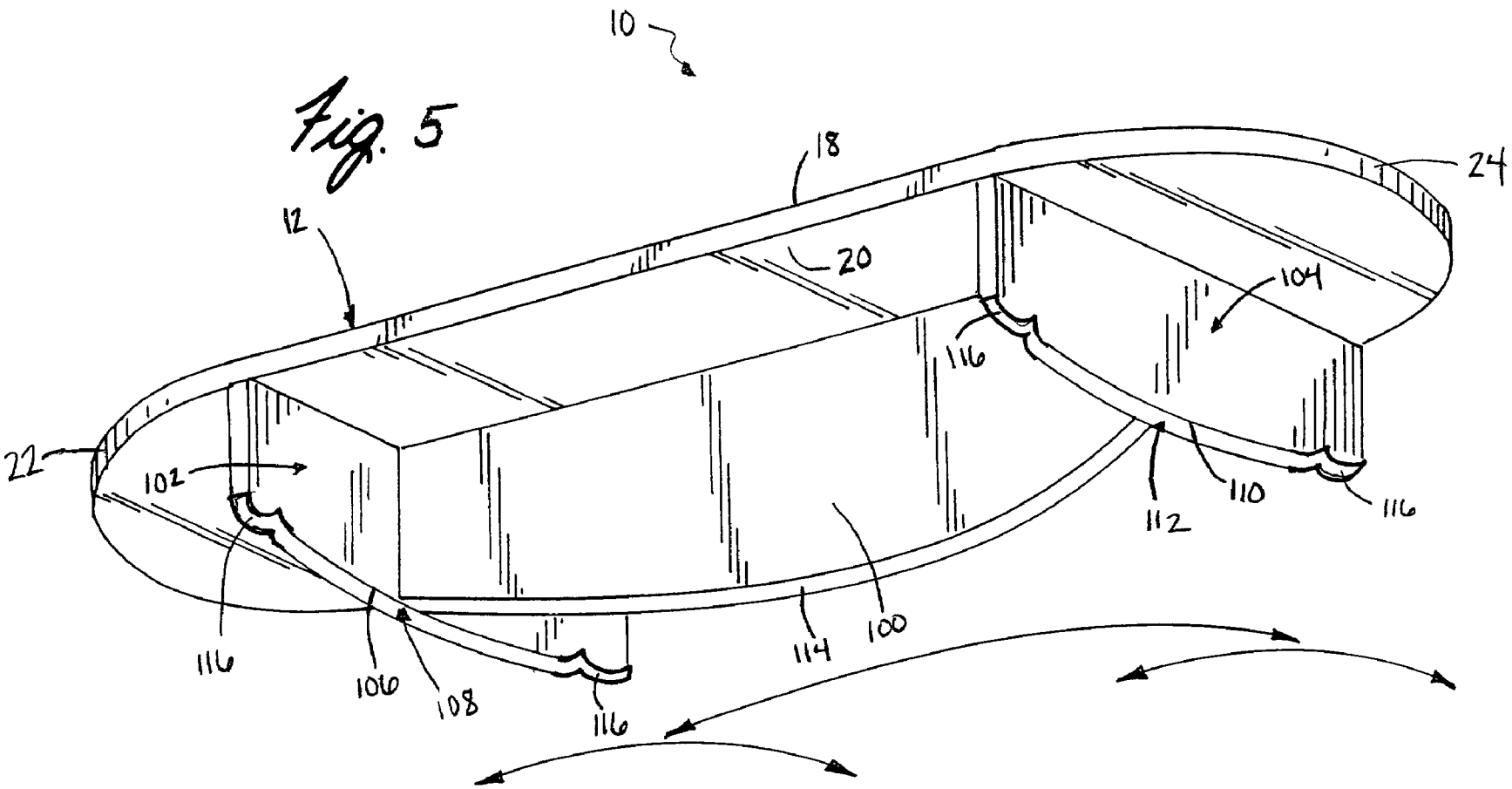
FIG. 5 is a bottom perspective view of a second embodiment of the stretching device.

FIG. 5 is a bottom perspective view of a second embodiment of the present invention stretching device 10. The stretching device 10 of the second embodiment includes a middle rocker 100 which is configured to allow the stretching device 10 to rock forward and backward. A front support 102 and rear support 104 having the same vertical dimension are also included in the stretching device 10 and configured to allow the stretching device 10 to rock side to side (as seen in the first embodiment discussion). Whereas the first embodiment of the stretching device allows side to side rocking with the front of the foot plate elevated above the rear, the second embodiment of the stretching device allows side to side rocking as well as front to rear rocking of the stretching device, albeit not simultaneously.

The stretching device 10 of the second embodiment includes the foot plate 12, the foot support 40, and first and second wedges 30 and 32 shown and discussed with respect to the first embodiment. The stretching device 10 also includes the front support 102, the rear support 104 and the middle rocker 100. The front support 102 and the rear support 104 extend from the bottom surface 20 of the foot plate 12. The front support 102 is located near the front end 22 and the rear support 104 is located near the rear end 24 of the foot plate. The front support 102 and the rear support 104 have substantially the same vertical dimension. The front support 102 has a bottom edge 106 configured to form a front rocker 108 and the rear support 104 has a bottom edge 110 configured to form a rear rocker 112.

The middle rocker 100 extends downward from the bottom surface 20 of the foot plate 12. Preferably, the middle rocker 100 is positioned substantially between the front support 102 and the rear support 104 and along the longitudinal axis of the foot plate 12. The middle rocker 100 has a lower arcuate shaped surface with an apex 114. In one embodiment of the present invention the middle rocker has a width of about four inches. The middle rocker is flanked on opposite ends by the front and rear supports 102 and 104 which extend from the bottom surface 20 of the foot plate 12. The middle rocker 100 is configured to allow the stretching device 10 to rock forward (plantar flexion) and backward (dorsiflexion) during use. Forward (plantarflexion) and backward (dorsiflexion) motion of the stretching device 10 dynamically stretches the lower extremities in the sagittal plane. The front and rear supports 102 and 104 form stops that limit the range of forward and backward rocking to prevent the middle rocker 100 from over rotating about a lateral axis of the stretching device 10. The middle rocker 100 preferably rocks forward about 10 degrees and backward about 10 degrees for a total sagittal plane motion of about 20 degrees.

The bottom edges 106 and 110 of each rocker 108 and 112 has an arcuate mid portion. Each rocker 108 and 112 has a stop 116 which extends from each end of the mid portion. When the stretching device 10 is rotated forward or backward on the middle rocker 100, the stretching device will balance on the mid portion of the front rocker 108 or the rear rocker 112, respectively. Thus, when the stretching device 10 is rotated forward on the middle rocker 100, the front rocker 108 allows the stretching device 10 to rock from side to side. Likewise, when the stretching device 10 is rotated backward on the middle rocker 100, the rear rocker 112 allows the stretching device 10 to rock from side to side. The side to side motion of the stretching device 10 allows frontal plane stretching of lower extremities. The stops 116 limit the range of side to side rocking to prevent the stretching device 10 from rotating past a particular angle on either side, preferably about 10 degrees, for a total frontal plane of motion of about 20 degrees.

The stretching device of the present invention allows for biomechanically correct stretching of the muscles of the lower extremities in all three planes of movement and in a functional, weight bearing position. The muscles and joints of the lower extremities interact with each other and with gravity and ground reaction forces. The stretching device has been designed to mainly stretch the Achilles and calf muscle group, the hamstring muscle, the IT band and the hip external rotators. The front and rear rockers allow calcaneal eversions/inversions (frontal motion) of the lower extremities. The sagittal plane angle created by either the elevated foot plate or the middle rocker allows dorsiflexion. The wedges for the forefoot increase the amount of midtarsal motion and allow placement of the leg in either internal rotation or external rotation resulting in transverse plane stretching.

Although the present invention has been described with reference to preferred embodiments, workers skilled in the art will recognize that changes may be made in form and detail without departing from the spirit and scope of the invention.

What is claimed is:

1. An apparatus configured for support on a surface and aiding in stretching lower extremity muscles of a person in a sagittal plane, a frontal plane, and a transverse plane, the apparatus comprising:

a plate sized to approximate a foot of the person, the plate having a front end, a rear end, a first edge, a second edge, a top side, and a bottom side, the first and second edges extending between the front and rear end;

a rear support associated with the bottom side near the rear end of the plate, the rear support having a width generally extending from the first edge to the second edge and a height generally extending from the surface to the bottom side of the plate;

a front support associated with the bottom side near the front end of the plate, the front support having a width generally extending from the first edge to the second edge and a height generally extending from the surface to the bottom side of the plate, the height of the front support being greater than that of the rear support; and means for enabling the apparatus to rock between the first edge and the second edge.

2. The apparatus of claim 1, and further comprising:

a first member to elevate a side of the foot above the plate, the first member positioned on the top side of the plate and adjacent the first edge; and a second member to elevate a side of the foot above the plate, the second member positioned on the top side of the plate and adjacent the second edge.

3. The apparatus of claim 2 wherein the first member and the second member are comprised of inclined surfaces which extend from the plate with respect to the first and second edge respectively at an angle of about 15 degrees.

4. The apparatus of claim 1 wherein the means for enabling the apparatus to rock comprises:

a front rocker formed on a bottom edge of the front support; and a rear rocker formed on a bottom edge of the rear support.

5. The apparatus of claim 4 wherein the front rocker further comprises a stop at each end of the front rocker to prevent the apparatus from rocking at an angle greater than about 10 degrees.

6. The apparatus of claim 4 wherein the rear rocker further comprises a stop at each end of the rear rocker to prevent the apparatus from rocking at an angle greater than about 10 degrees.

7. The apparatus of claim 1, and further comprising a foot support located on the top side and positioned proximate the rear end of the plate.

8. The apparatus of claim 1, and further comprising a middle rocker positioned between the front support and the rear support wherein the middle rocker rocks the apparatus between the front end and the rear end.

9. An apparatus configured for support on a surface and aiding in stretching a person's lower extremity muscles, the apparatus comprising:

a foot plate having a top side, a bottom side, a first edge, a second edge, a front end and a rear end and a longitudinal axis, the first and second edges defining a length of the foot plate and the front and rear ends defining a width of the foot plate, wherein a foot of the person is supportable along the longitudinal axis of the foot plate;

a first member positioned on the top side along the first edge of the foot plate and a second member positioned on the top side along the second edge of the foot plate wherein the first and second members are configured to elevate a side of the foot of the person above the foot plate when the foot supported on the longitudinal axis is pivoted relative to the longitudinal axis of the foot plate;

a rear support associated with the bottom side near the rear end of the foot plate, the rear support having a width generally extending from the first edge to the second edge and a height generally extending from the surface to the bottom side of the foot plate;

a front support associated with the bottom side near the front end of the foot plate, the front support having a width generally extending from the first edge to the second edge, the front support having a height between the surface and the bottom side of the foot plate that is greater than that of the rear support; and wherein the front and rear supports are configured to enable the apparatus to rock between the first edge and the second edge.

10. The apparatus of claim 9 wherein the first member and the second member are comprised of inclined surfaces which extend from the foot plate with respect to the first and second edge respectively at an angle of about 15 degrees.

11. The apparatus of claim 9 wherein the front and rear supports comprise:

a front rocker formed on a bottom edge of the front support; and a rear rocker formed on a bottom edge of the rear support.

12. The apparatus of claim 11 wherein the front rocker further comprises a stop at each end of the front rocker to prevent the apparatus from rocking at an angle greater than 10 degrees.

13. The apparatus of claim 11 wherein the rear rocker further comprises a stop at each end of the rear rocker to prevent the apparatus from rocking at an angle greater than 10 degrees.

14. The apparatus of claim 9, and further comprising a foot support located on the top side and positioned proximate the rear end of the foot plate.

15. The apparatus of claim 9, and further comprising a middle rocker extending from the bottom side of the foot plate wherein the middle rocker rocks the apparatus between the front end and the rear end.

* * * * *